United States Patent [19]

Myers

[11] 3,945,004

[45] Mar. 16, 1976

[54] HIGH EFFICIENCY BUZZER

[75] Inventor: John L. Myers, Dayton, Ohio

[73] Assignee: Projects Unlimited, Inc., Dayton, Ohio

[22] Filed: July 11, 1974

[21] Appl. No.: 487,716

[52] U.S. Cl. ..... 340/384 E; 340/384 R; 340/393; 340/388

[51] Int. Cl.[2] ..... G08B 3/10

[58] Field of Search ..... 340/384 E, 384 R, 392, 340/393, 388; 331/64

[56] References Cited

UNITED STATES PATENTS

| | | | |
|---|---|---|---|
| 3,530,463 | 9/1970 | Spadini | 340/384 R |
| 3,846,792 | 11/1974 | Haigh | 340/384 E |

*Primary Examiner*—Harold I. Pitts

*Attorney, Agent, or Firm*—Biebel, French & Bugg

[57] ABSTRACT

An electronic buzzer has a tuned oscillating striker and an electronic oscillator circuit matched to the striker tuned frequency and driving the striker by close coupling of a driving coil to a core member which forms part of an electromagnetic circuit with the striker. The oscillator circuit also includes a control coil in the transistor base circuit and mounted within the driving coil for close coupling to the driving coil and the electromagnetic circuit. The control coil is optimized to have the maximum number of turns while still matching the effective input impedance of the transistor. A diode may be connected in shunt with the driving coil for improved feedback coupling and frequency tuning.

4 Claims, 3 Drawing Figures

HIGH EFFICIENCY BUZZER

BACKGROUND OF THE INVENTION

Various forms of miniature electronic buzzers have been proposed for use in small alarm clocks, timers, automotive and aircraft warning devices, and similar installations. There is always a variety of parameters to be considered in the design and large scale manufacture of such buzzers. The power and frequency requirements, audible output, sensitivity to changes in existing voltage, and ease and cost of manufacture, are all criteria that must be considered and balanced against each other. Considerable work has been devoted to achieving the best combination of these parameters.

In the prior art, typical miniature buzzers are disclosed in U.S. Pat. Nos. 2,977,418; 3,341,842; 3,530,463; and 3,564,542; and small buzzers employing piezo-electric devices are disclosed in U.S. Pat. Nos. 3,277,465; 3,331,970; 3,341,841; 3,569,963; and 3,697,983.

SUMMARY OF THE INVENTION

The present invention relates to a high efficiency buzzer using a transistor oscillator circuit which is designed in conjunction with the vibrating mechanical buzzer parts to produce maximum sound output from a device which is relatively simple and inexpensive to manufacture. The driving coil, for inducing a regularly fluctuating electromagnetic field in a core member, is connected in series circuit with a power supply and the emitter-collector circuit of the transistor. A shunt circuit comprising a resistor and a diode (series connected) is also connected to the power supply in parallel with the transistor. A control coil is located within the driving coil, closely inductively coupled to the core member and the driving coil. The control coil is connected between the juncture of the resistor and diode and the base of the transistor.

The turns ratio of the driving coil to the control coil varies with the design exciting voltage. The control coil is an optimized coil which has the maximum number of turns which can still match the input impedance of the transistor. By design the control coil has approximately 3000 turns of No. 48 AWG copper wire, with approximately 1000 ohms impedance, to match the type 2N2222 transistor used in a typical 12 volt design. Preferably a diode is also connected in shunt across the driving coil, as a so-called free-wheeling diode, to decrease the frequency of the electronic oscillator circuit close to the mechanical frequency of the vibrating mechanical parts, e.g., the striker arm which repeatedly strikes a sounding diaphragm. This diode also increases the feedback or coupling factor between the vibrating striker arm and the control coil. Also, the diode in the shunt circuit is type matched to the transistor, i.e., both are silicon, or both germanium, etc., components.

The object of the invention, therefore, is to provide such a high output, efficient and relatively voltage insensitive buzzer.

Other objects and advantages of the invention will be apparent from the following description, the accompanying drawings and the appended claims.

DESCRIPTION OF THE PREFERRED EMBODIMENTS

Figure 1:
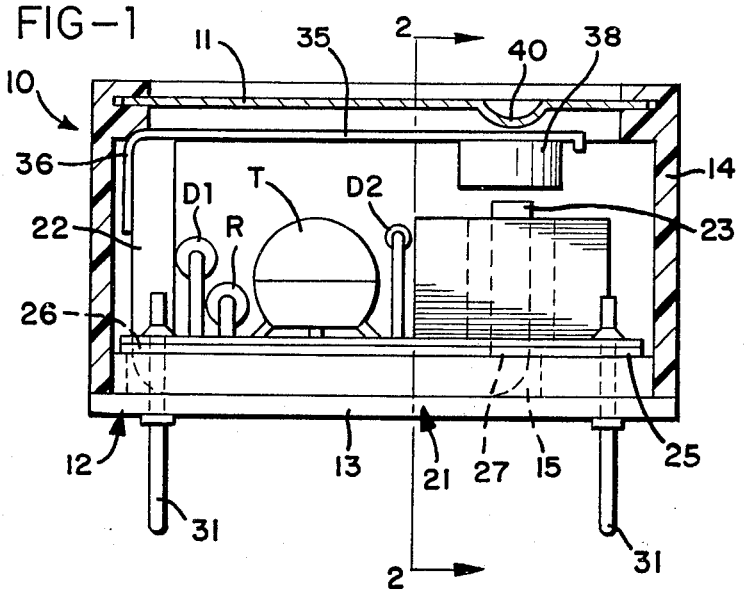
FIG. 1 is a longitudinal sectional view of a typical buzzer embodying the invention.
Figure 2:
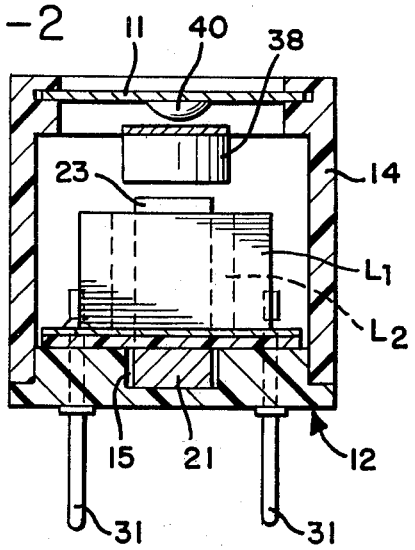
FIG. 2 is a sectional view taken along lines 2—2 of FIG. 1.

The buzzer, as shown in FIGS. 1 and 2 consists of a base assembly 12 onto which a housing 10 has been secured by a suitable cement, or by electronic welding, or some other suitable means. The top wall of the housing 10 consists of a metal diaphragm 11 which is preferably molded into the plastic side walls 14 of the housing. Other suitable materials can be used for the diaphragm. This general design of buzzer and housing is the subject of application Ser. No. 479,270 filed June 14, 1974, which is assigned to the assignee of this application.

The base assembly consists of a plastic base 13 with a recess 15, such that a U-shaped core 21 of iron or other material of high magnetic permeability fits into the base. A circuit board 25, with a slot 26 on one end and a hole 27 near the other end, is fitted over the core 21 and onto the base, such that the long core leg 22 fits through the slot 26 and the short core leg 23 fits through the hole 27.

Figure 3:
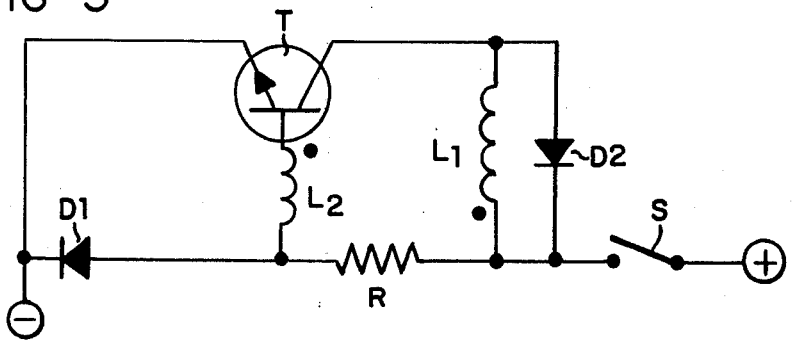
FIG. 3 is a diagram showing the novel circuit which is a principal part of the invention.

A set of two windings (L1 and L2) is placed around the short core leg and is incorporated in the circuit which operates the buzzer. The individual windings are represented in FIG. 3. Circuit connection pins 31, which fit through holes in the circuit board 25 and plastic base 13, project from the plastic base and connect the circuit to an external power source, for example through some form of condition responsive switching mechanism S (FIG. 3) which will apply power to the circuit in response to the existence of some condition as to which a warning is desired.

One end of a striker arm 35 is formed over the end of the longer core leg 22 as shown at 36, and welded to it, and a magnet 38 is secured to the other or free end of the striker arm, positioned such that directly above the striker arm and magnet is the apex of a circular recess or dimple 40 in the diaphragm 11, and directly below is the shorter core leg 23. Thus the core and magnet form the magnetic circuit, and with an oscillating magnetic field induced in the core 21, the magnet secured to the striker arm is alternatively attracted and released, or repelled and released, from the core leg 23, and will strike diaphragm 11 in such a manner to produce an audible sound. By locating the weld at the turned end 36, heat from the welding operation does not affect the temper of the heat treated steel spring striker arm 35 from its pivot point outward to the free end. Also the arm 35 may be suitably tapered in a lengthwise direction to give a more uniform spring action and, along with other factors, to achieve the highest Q for the oscillating arm-magnet system.

Referring to FIG. 3, the power supply is indicated by positive and negative symbols and the switch S represents a suitable switching device controlling power to the circuit. The switching device may be closed in response to any condition, or combination or conditions, as to which an audible indication is desired.

The transistor T is shown as of the n-p-n type, and the driving coil L1 is connected in series circuit with the transistor's collector-emitter connections. In parallel with that circuit path, across the supply, is a series circuit comprising resistor R and diode D1. The control or feedback coil L2 is connected between the base of the transistor T and the junction of R and D1. A diode D2 is connected in shunt across coil L1, as shown.

Coil L2 is mounted directly around the short leg 23 of the core piece, and coil L1 is mounted directly around coil L2. This arrangement provides a most efficient electromagnetic coupling between the core piece, L1 and L2. In order to achieve the desired efficiency and control, it has been found that the impedance of L2 should be matched to the impedance of the transistor T, while still having the maximum possible number of turns. Thus, L2 does not vary for different design voltages, whereas for L1 the turns vary directly as the design voltage and its impedance varies as the square of the voltage. Diode D1 is selected of the same material type as transistor T, that is, if a silicon transistor is used, diode D1 is a silicon diode. The values of the components are chosen to produce an oscillator frequency which is approximately one and one-half times the mechanical natural frequency of the oscillating arm-magnet system. This allows the oscillating mechanical parts to synchronize readily with the electronic oscillator for maximum efficiency. Diode D2 is utilized as a free-wheeling diode to decrease the oscillator frequency easily to the desired value, usually in the range of 500–700 Hz, and to increase the mechanical-electrical coupling factor between the vibrating arm-magnet assembly and the electronic circuit.

In a typical small buzzer constructed according to the invention, the physical size may be as small as one-fourth the size shown in the drawings. Components actually used in a successful embodiment of a 12 volt design are as follows:

T — type 2N2222
R — 6800 ohms
D1 — type 1N914/1N4148
D2 — type 1N914/1N4148
L1 — 1500 turns of No. 44 wire
L2 — 3000 turns of No. 48 wire Power supply for this configuration is an unregulated 12 volts, which may vary ±several volts without affecting the reliable operation of the buzzer.

Various configurations obviously are possible within the scope of the invention. Also, instead of discrete components, all electronic components can be provided on an integrated circuit chip.

While the form of apparatus herein described constitutes a preferred embodiment of this invention, it is to be understood that the invention is not limited to this precise form of apparatus, and that changes may be made therein without departing from the scope of the invention.

What is claimed is:

1. A driving arrangement for an electromagnetic oscillating member including a core member of high magnetic permeability and an armature movably mounted proximate to said core member, a driving coil mounted to induce a magnetic flux in said core member, and an electronic oscillator circuit connected to said driving coil, comprising a power supply, a transistor, said driving coil being connected in series with said power supply and the emitter-collector circuit of said transistor, a resistor and a diode series connected to each other and to said power supply, a control coil connected between the junction of said resistor and diode and the base of said transistor and having an impedance matched to the input impedance of said transistor, said control coil being surrounded by said driving coil and inductively coupled to said core member, and said oscillator circuit having a free running frequency greater than and matched to the natural mechanical vibration frequency of the armature.

2. A device as defined in claim 1, including a diode connected in shunt across said driving coil.

3. A device as defined in claim 1 wherein said diode and said transistor are the same type of semi-conductor.

4. An electronic buzzer having a core member of generally U-shape and an armature including an arm fastened to one leg of said core member and extending in cantilever fashion across the open end of said core member terminating in a free end adjacent to the other leg of said core member, said arm having a predetermined natural mechanical vibration frequency, an acoustical member, and means driven by said arm and arranged to strike said acoustical member;

the improvement comprising an electronic oscillator circuit coupled to said core member and incorporating power supply connections, a transistor, a driving coil connected in a series circuit with said power supply connections and the emitter-collector circuit of said transistor, a shunt circuit comprising a resistor and a diode connected in series with said power supply connections, a control coil connected between the base of said transistor and the junction between said diode and said resistor and having an optimum number of turns of fine wire such that the impedance of said control coil matches the input impedance of said transistor, said control coil being inductively coupled to said core member and being surrounded by said driving coil, and the values of the components of the oscillator circuit being so related that the free running frequency of said electronic oscillator is greater than the tuned frequency of said vibrating arm by a constant multiplier whereby said arm will synchronize with the oscillator to produce maximum sound output.

* * * * *